US006288372B1

(12) United States Patent
Sandberg et al.

(10) Patent No.: US 6,288,372 B1
(45) Date of Patent: Sep. 11, 2001

(54) ELECTRIC CABLE HAVING BRAIDLESS POLYMERIC GROUND PLANE PROVIDING FAULT DETECTION

(75) Inventors: Chester L. Sandberg, Palo Alto; Albert J. Highe, Redwood City; Jose Gamarra, Union City; Lawrence J. White, Newark; Frank Orecchia, Redwood City; Ted M. Aune, Boulder Creek, all of CA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/432,688

(22) Filed: Nov. 3, 1999

(51) Int. Cl.[7] ..... H05B 3/44
(52) U.S. Cl. ..... 219/544; 219/553
(58) Field of Search ..... 219/538, 541, 219/542, 544, 546, 552, 553, 549, 528

(56) References Cited

U.S. PATENT DOCUMENTS

| | | | | |
|---|---|---|---|---|
| 3,032,604 | | 5/1962 | Timmons | 174/115 |
| 3,211,821 | | 10/1965 | Wakefield | 174/26 |
| 3,340,353 | | 9/1967 | Mildner | 174/106 |
| 3,673,315 | | 6/1972 | Lasley | 174/107 |
| 3,823,304 | | 7/1974 | Siemianowski | 219/213 |
| 3,927,247 | | 12/1975 | Timmons | 174/36 |
| 4,177,446 | | 12/1979 | Diaz | 338/212 |
| 4,223,209 | | 9/1980 | Diaz | 219/549 |
| 4,246,468 | * | 1/1981 | Horsma | 219/553 |
| 4,318,220 | | 3/1982 | Diaz | 29/611 |
| 4,392,051 | | 7/1983 | Goss et al. | 219/528 |
| 4,426,339 | * | 1/1984 | Kamath et al. | 264/22 |
| 4,459,473 | * | 7/1984 | Kamath | 219/553 |
| 4,471,215 | | 9/1984 | Blumer | 219/553 |
| 4,553,024 | | 11/1985 | Findlay | 218/335 |
| 4,659,913 | * | 4/1987 | Midgley et al. | 219/549 |
| 4,698,583 | * | 10/1987 | Sandberg | 324/546 |
| 5,218,185 | | 6/1993 | Gross | 219/528 |
| 5,245,161 | | 9/1993 | Okamoto | 219/549 |
| 5,300,760 | * | 4/1994 | Batliwalla et al. | 219/549 |
| 5,317,061 | * | 5/1994 | Chu et al. | 525/200 |
| 5,361,183 | | 11/1994 | Wiese | 361/42 |
| 5,521,358 | | 5/1996 | Eilentropp | 219/549 |
| 5,782,301 | | 7/1998 | Neuroth et al. | 166/302 |
| 5,925,276 | | 7/1999 | Batiwalla et al. | 219/553 |
| 6,005,232 | * | 12/1999 | Janvrin et al. | 219/549 |

FOREIGN PATENT DOCUMENTS

| | | | |
|---|---|---|---|
| 3735977 | 5/1989 | (DE) | H05B/1/02 |
| 0 930 804 A2 | 7/1999 | (EP) . | |
| 2519505 | 7/1983 | (FR) | H05B/3/56 |
| 1182300 | 2/1970 | (GB) | H05B/3/48 |
| 2071442 | 9/1981 | (GB) | G01R/19/06 |
| WO91/17642 | 11/1991 | (WO) | H05B/3/00 |
| WO96/34511 | 10/1996 | (WO) | H05B/3/56 |
| WO 98/01010 | 1/1998 | (WO) . | |

OTHER PUBLICATIONS

European International Search Report for International Application No. PCT/US00/29534 dated Jan. 18, 2001.

* cited by examiner

*Primary Examiner*—Tu Ba Hoang

(57) ABSTRACT

An electrical cable device such as a heating cable includes a braidless ground return layer surrounding an inner jacket. The ground return layer is formed by a conductive polymer and a ground return wire connected to the conductive polymer. The polymer may be made suitably conductive for ground fault detection by addition of a particulate conductive filler such as carbon black, carbon fibers, or a blend thereof.

29 Claims, 4 Drawing Sheets

ELECTRIC CABLE HAVING BRAIDLESS POLYMERIC GROUND PLANE PROVIDING FAULT DETECTION

BACKGROUND OF THE INVENTION

1. Field of the Invention

The present invention relates to electrical devices. More particularly, the present invention relates to electric cables, heating cables, and the like, having a ground plane layer of conductive polymer and drain conductor for providing ground fault detection.

2. Introduction to the Invention

Heating cables are well known in the art. These electrical devices typically comprise an elongate resistance body of an organic polymer such as a polyethylene or polyvinylidene fluoride having a particulate conductive filler such as carbon black effectively dispersed therein. The body is typically melt-extruded over two or more suitably gauged stranded metal (e.g. nickel or tin-coated copper) wires to produce an inner heater having a generally rectangular, oval or dog-bone cross-section. Many of these types of known electrical devices include a metallic braid which is provided to act as an electrical ground path and also to provide some mechanical reinforcement of the cable device. In many instances the heating cable has a resistance element manifesting a positive temperature coefficient (PTC) which renders the heater self-regulating about a desired temperature generally irrespective of its particular length. Self-regulating heating cables are commonly used as heaters for bodies such as liquid-containing vessels, and structures or substrates such as pipes, within chemical processes or other systems requiring temperature maintenance. Since heating cables may be used in a wide variety of applications and configurations, it is highly desirable that the heating cables manifest a sufficient degree of mechanical flexibility in order to be wrapped around pipes to be heated as well as providing a sufficient degree of toughness, wear resistance, and longevity. Heating cables powered by single phase AC power may extend for up to 1200 feet in length or longer, for example. Three-phase strip heaters may extend much farther, up to 12,000 feet in length or longer, for example.

It is useful and important to monitor the condition of a heating cable that may have been improperly installed in the first instance, or may have sustained physical damage or degradation after installation, such as a cut, puncture, tear, break, abrasion or other failure mode of the outer insulation, or of a ground braid element of the heater, in response to external impact or other externally caused abuse or misuse. By monitoring the heating cable condition one can increase the safety and reduce the possibility that a damaged heating cable will be used or remain in service and protect against hazards to personnel and equipment posed by any continuing use of damaged heating cables such as, for example, an explosion or a fire, particularly within hazardous environments. In order to protect against continued use of damaged heating cables, ground-fault protection devices ("GFPDs") may be employed. GFPDs generally function to sense a current imbalance, trip, and thereupon interrupt a source of electrical power to the strip heater as by opening a circuit breaker or a set of contacts at a power distribution circuit breaker panel. GFPDs may be included within breaker switches. Discrete GFPDs may alternatively be installed at branch circuit breaker panels. GFPD equivalent functions may also be included within temperature/operational control or monitoring apparatus to which a heating cable may be connected. GFPDs for protecting apparatus and equipment are designed to trip at a relatively low fault current detection level, such as 20 mA to 360 mA or higher, and most typically 30 mA. GFPDs typically include, but are not limited to, ground-fault circuit interrupt (GFCI) devices which provide ground fault protection for personnel against shock. GFCI devices are typically set to trip at a 5 mA current level.

One example of a method of monitoring a heating cable for faults is described in U.S. Pat. No. 4,698,583 to co-inventor Chester L. Sandberg, entitled "Method of Monitoring a Heater For Faults", the disclosure thereof being incorporated herein by reference.

With reference to FIGS. 1 and 2 a conventional self-regulating heating cable 10 is shown as including two stranded electrical conductor 12 and 14. In this particular example, the conductor 12 is denominated the phase lead and conductor 14 is denominated the neutral (return) lead. The conductor wires 12 and 14 are effectively and intimately embedded within a heater body 16 most preferably comprising a matrix polymer and conductive particles effectively dispersed therein. The heater body 16 most preferably manifests a positive temperature coefficient (PTC), so that the heating cable 10 is self-regulating about a design temperature following application of operating power, such as about 120 volts (alternating current) for example.

An inner jacket 18 of nonconductive thermoplastic or elastomeric material, such as polyethylene or ethylene-propylene-diene monomer (EPDM), respectively, is extruded over the heater body 16, preferably using a tube-down extrusion technique. The innerjacket 18 and body 16 are then exposed to an electron beam or other ionizing radiation source at a selected energy level and for a controlled time period as to promote polymer crosslinking.

A metal wire braid 20 is woven or otherwise placed over the inner jacket 18. A standards-specified ground plane braid, such as wire braid 20, has a woven strand mesh density such that a 1 mm diameter probe passing through an outer jacket 22 at any arbitrary location will necessarily come into electrical contact with one or more strands of the braid. The braid 20 forms a ground plane for the heating cable 10.

Using a tube-down extrusion technique, an outer jacket 22 of nonconductive material, which may be of the same type as the inner jacket 18, is extruded over the wire braid 20. Accordingly as shown in FIGS. 1 and 2, the conventional self-regulating heater cable 10 includes (progressively from its periphery to its center) the outer insulative jacket 22, the wire braid 20, the inner insulative jacket 18, and the conductive polymer matrix heater body 16 which envelopes and electrically connects to the phase and neutral conductor wires 12 and 14.

An alternative conventional heating cable construction 25 is shown in the FIG. 1A view. In this example, the phase and neutral stranded copper bus wire electrodes 12 and 14 are spaced apart by a nonconductive polymeric spacer 15. A plurality of self-regulating conductive polymeric-fiber heating elements 17 are wrapped around, and connected to, the phase and neutral electrodes 12 and 14. The construction 25 includes a conventional tinned-copper wire braid jacket 20, and a nonconductive outer jacket 22 of e.g. fluoropolymer. Heating cables in accordance with the FIG. 1 cable construction 25 are described in greater detail in U.S. Pat. No. 4,459,473 to Kamath, entitled "Self-Regulating Heaters", the disclosure of which is incorporated herein by reference.

As shown in FIG. 3, electrical power is supplied to the cable 10 from a breaker panel 24 including a circuit breaker 26 for selectively connecting the phase conductor 12 to a phase bus 28. The neutral conductor 14 is typically returned to a neutral bus 30 at the breaker panel 24. A GFPD 32 typically located at the breaker panel 24 is connected to the conductors 12 and 14, and to the neutral bus 30. Braid 20 is then connected to ground. Any imbalance in current between the phase conductor 12 and the neutral conductor 14 is detected by the GFPD 32, and if the imbalance is above a predetermined trip threshold, such as 30 mA, the GFPD 32 trips breaker 26 which thereupon disconnects the phase conductor 12 from the phase bus 28. One reason for a current imbalance is an unwanted ground fault between the wire braid 20 and the phase conductor 12, such as a current-leakage path 34 at some location along the cable 10. The current-leakage path 34 may be the result of abuse such as cutting, tearing or abrasion of the cable 10, or may be caused by excessive blows or compression applied to the cable 10 at the site of the current-leakage path 34.

Whatever the reason for the fault, the GFPD 32 functions to detect the ground fault and trip breaker 26. Of course, if the current-leakage path 34 constitutes a very low-resistance direct short which passes significantly more current than the rating of the breaker 26, the breaker 26 will ordinarily trip normally without GFPD intervention, and disconnect the phase conductor 12 in conventional fashion.

Preferred methods for making a self-regulating strip heater such as cable 10 are taught in U.S. Pat. No. 4,426,339 to Kamath et al., entitled "Method of Making Electrical Devices Comprising Conductive Polymer Compositions"; and U.S. Pat. No. 5,300,760 to Batliwalla et al., entitled "Method of Making an Electrical Device Comprising a Conductive Polymer", the disclosures thereof being incorporated herein by reference.

There are several recognized drawbacks arising from the use of a braided ground plane layer, such as wire braid 20. For one thing, a wire braid requires using a relatively slow wire braiding machine for braiding multiple strands of wire and applying the braided strands to the heater body and inner jacket composite in the manufacturing process. Also, broken wire strands or bunching up of the wire braid can result in defects in the outer insulative jacket and can reduce yields in downstream manufacturing operations. Another drawback stems from the fact that if moisture contacts the wire braid, as when a cut or tear or other defect through the outer jacket 22 permits moisture to enter, corrosion of the wire braid layer 20 can develop and progressively extend along a considerable length of the cable. One further drawback stemming from the wire braid 20 is the difficulty in preparing a heating cable end for electrical connection. In this regard, the outer jacket 22 must be stripped off, and the wire braid 20 then parted into a separate conductor for connection to ground. Thus, it would be very desirable to provide a "braidless" elongate electrical cable, such as a heating cable, with effective ground-fault detection wherein the cable does not require or include a woven wire strand ground plane braid component or layer within the cable construction.

SUMMARY OF THE INVENTION

The present invention provides a cable construction, such as a braidless heating cable, which has in lieu of a wire braid ground shield an electrically conductive but still flexible polymeric jacket containing one or two drain wires in order to provide a low resistance path to ground should a fault condition occur. More specifically, the present invention is an electrical device such as a heating cable which includes (1) a resistive element having first and second elongate wire electrodes which are in direct electrical contact with a conductive polymer; (2) an inner insulating jacket layer surrounding the resistive element; and (3) a braidless ground plane layer surrounding the inner insulative jacket layer and comprising at least one drain wire electrode which is in effective electrical contact with a continuous layer of conductive polymer. In one preferred form the braidless ground plane layer comprises a polymer matrix containing a particulate conductive filler, such as carbon black, or carbon fibers, or a blend of carbon black and carbon fibers.

In a related aspect the present invention resides in an elongate laminar electrical cable including an inner layer comprising at least one insulated conductor. In one preferred embodiment the inner construction comprises a heating element and an insulative inner jacket. The improvement comprises a ground plane layer surrounding the inner construction. The ground plane layer comprises at least one drain conductor in effective electrical contact with a layer including a conductive polymer which covers the inner construction. The conductive polymer of the layer has a volume resistivity characteristic such that an electrical resistance measured at a terminal end of the electrical cable when a shorting means connects the ground plane layer to one of the insulated wire(s) at a location along the cable has a first resistance value before an operating electrical potential difference is applied between the insulated conductor and the drain conductor, and has a second resistance value at least less than half, and most preferably up to less than one fifth, of the first resistance value following application of the operating electrical potential difference between the insulated conductor and the drain conductor.

As a further aspect of the present invention a method provides ground fault protection for an elongate electrical device such as an electrical cable, heating cable, and the like, having an insulated core including at least one electrical conductor and having a ground plane layer comprising a conductive polymer material formed over the insulated core and at least one ground fault wire in effective electrical contact with the conductive polymer material. The method includes the steps of connecting the at least one electrical conductor to an electrical energy supply; connecting the at least one electrical conductor and the at least one ground fault wire to ground fault protection circuitry; and, operating the ground fault protection circuitry in a manner such that current flow between the at least one electrical conductor and the at least one ground fault wire above a predetermined threshold level at a fault location of the electrical cable, heating cable, and the like, causes the ground fault protection circuitry to trip and cause disconnection of the at least one electrical conductor from the electrical energy supply.

Advantages and benefits flowing from this elongate electrical device include a reduction of corrosion of the ground fault protection layer (i.e. no exposed metallic components such as wire braid), prevention of possible moisture migration along the cable if its outer jacket becomes damaged, simplification of the manufacturing process by elimination of the time-consuming step required to make wire braided strip heaters, and improved ease of termination end preparation and electrical connection including use of insulation-displacement connectors for directly making all connections to the electrical cable.

These and other objects, advantages, aspects and features of the present invention will be more fully understood and appreciated by those skilled in the art upon consideration of the following detailed description of preferred embodiments, presented in conjunction with the accompanying drawings.

BRIEF DESCRIPTION OF THE DRAWINGS

The invention is illustrated in the accompanying drawings, in which.

DETAILED DESCRIPTION OF THE INVENTION

Figure 1:
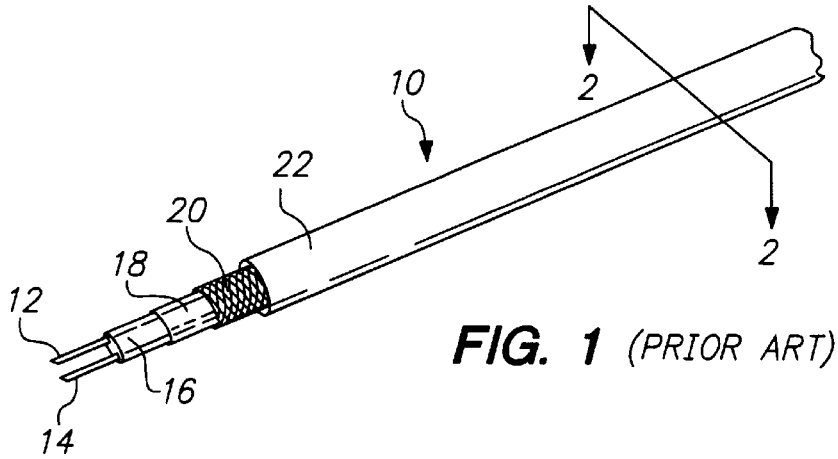
FIG. 1 (PRIOR ART)
FIG. 1 is an isometric view of an electrical heating cable including a conventional braided wire ground plane layer, showing progressive stripping away of layers of the construction.
Figure 2:
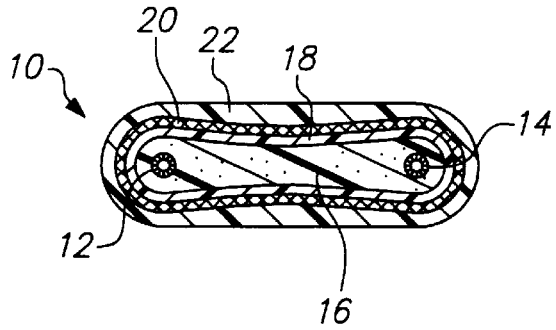
FIG. 2 (PRIOR ART)
FIG. 2 is an enlarged cross-sectional view of the FIG. 1 heating cable along section line 2—2 in FIG. 1.
Figure 3:
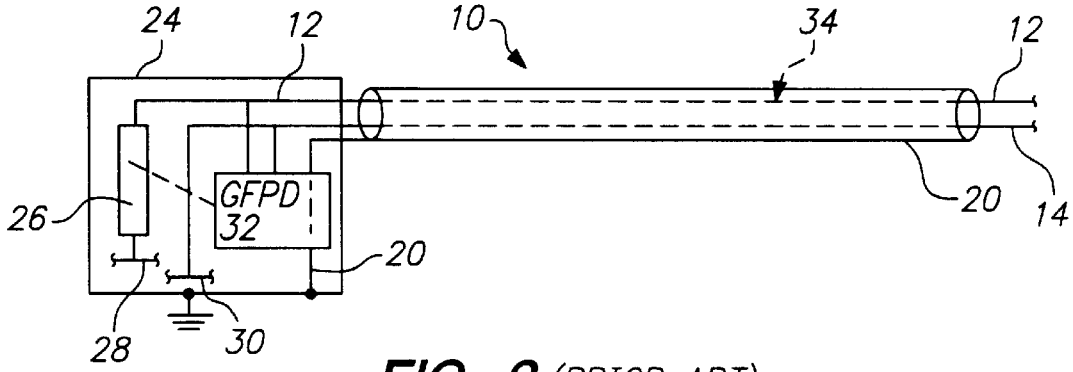
FIG. 3 (PRIOR ART)
FIG. 3 is an electrical block diagram of a circuit including the conventional heating cable of FIG. 1.
Figure 4:
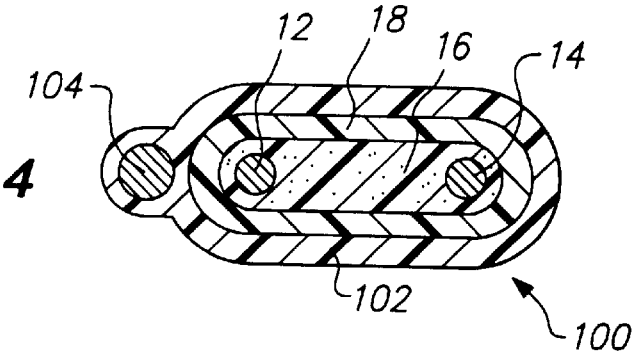
FIG. 4 is an enlarged, diagrammatic cross-sectional view of an electrical heating cable having a ground plane layer including a conductive polymer and a drain wire embedded in the conductive polymer, in accordance with principles of the present invention.

Turning to FIG. 4, a braidless heating cable 100 in accordance with principles of the present invention has a ground plane layer 102 formed of conductive polymer and a drain wire 104 in lieu of the conventional wire braid layer 20 shown in FIGS. 1 and 2. The term "braidless", as used herein, means a cable, such as but not limited to a heating cable, which does not include a wire braid layer having the standards-specified woven strand mesh density described above in the Background section, or an equivalent thereof such as a metal-foil-wrapped electrical cable (with or without ground return wire). The other elements of the representative heating cable 100 remain the same as previously used, including the phase conductor 12, the neutral conductor 14, the heater body 16 and the nonconductive polymeric inner jacket 18.

Figure 1A:
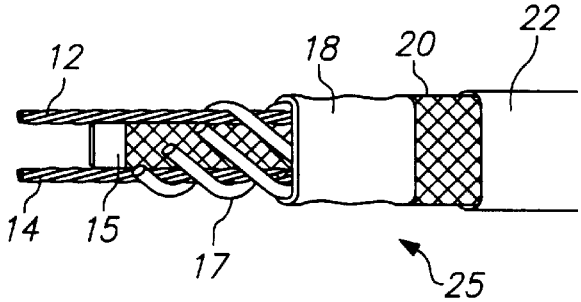
FIG. 1A (PRIOR ART)
FIG. 1A is a diagrammatic view of another electrical heating cable construction including a conventional braided wire ground plane layer, also showing progressive stripping away of layers of the construction.
Figure 4A:
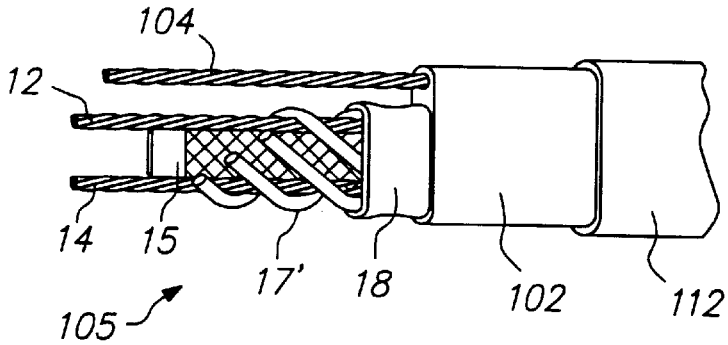
FIG. 4A is a diagrammatic view of an electrical heating cable construction having heating elements similar to those depicted in FIG. 1A and being surrounded by a braidless polymeric ground plane structure in accordance with principles of the present invention.

While in a preferred embodiment the heating cable has two elongate electrodes embedded in conductive polymer, it is also possible to use a polymeric ground plane with a heating cable in which the first and second electrodes are wrapped with a continuous strip (e.g. a fiber) comprising a conductive polymer as shown in FIG. 1A hereof and as described hereinabove and in referenced U.S. Pat. No. 4,459,473 to Kamath, entitled "Self-Regulating Heaters", previously incorporated herein by reference. Alternatively, the continuous strip can comprise a metallic heating wire. This arrangement is illustrated in FIG. 4A wherein a braidless heating cable 105 includes a two-conductor heater element of a type shown in FIG. 1A wherein the continuous heating strip 17' may be a polymer fiber or a wire. A nonconductive polymeric inner jacket 18 is surrounded by a ground plane layer 102 formed of electrically conductive polymer with a drain wire in lieu of the conventional wire braid 20 of the FIG. 1A construction. A nonconductive polymeric outer jacket 112 surrounds the ground plane layer 102.

In one preferred example the polymeric ground plane 102 comprises a polymer matrix material containing a particulate conductive filler. Suitable polymers for use as the matrix include polyolefins such as polyethylene and ethylene copolymers; thermoplastic elastomers (TPE); fluoropolymers (FP) such as polyvinylidene fluoride, fluorinated copolymers such as ethylene/tetrafluoroethylene copolymer (ETFE), fluorinated ethylene/propylene copolymer (FEP), perfluoroalkloxy (PFA), and chlorotrifluoroethylene (CTFE), and fluoroelastomers; and mixtures of one or more of these types of polymers. Suitable particulate fillers include carbon fibers; carbon black, in particular a relatively highly structured carbon black; and metal particles and fibers such as silver, nickel, or aluminum; metal-coated graphite fibers; and mixtures of one or more of these types of fillers. Intrinsically conductive polymers such as doped polyparaphenylene, doped polypyrrole, doped polythiophene and doped polyaniline, may also be used as particulate fillers. Since such intrinsically conductive polymers tend to be brittle, infusible and difficult to process, they most frequently are blended into another polymer to produce a material having desired mechanical as well as electrical properties.

Presently, the polymeric ground plane layer 102 most preferably contains particulate carbon material(s), as metal particles may be susceptible to corrosion in certain use environments, and metal particles suited for loading into a polymer matrix to provide desired conductivity of the resultant material are relatively expensive in comparison to carbon particles.

With respect to carbon blacks suited for use as conductive particulate filler for the ground plane layer 102, the term "structure" is commonly used to describe the chain or clustered formation of the particles in carbon black aggregates. The level of structure can be measured by oil absorption following the procedure outlined in ASTM D-2414, incorporated herein by reference. In the absence of significant porosity, oil (e.g. dibutylphthalate) absorption provides an indication of the average of the aggregate size/shape distribution of the carbon particles, reported as the DBP number. It is preferred that carbon blacks having a relatively high structure, i.e. a DBP number of at least 77 cc/100 g, preferably at least 100 cc/100 g, particularly at least 120 cc/100 g, be used. Examples of relatively highly structured carbon blacks are Vulcan™ XC-72, having a DBP number of about 188 cc/100 g, available from Cabot Corporation, and Ketjenblack™ EC300J, having a DBP number of about 340 cc/100 g, supplied by Noury Chemical Corporation.

Porosity is also a factor in maximizing electrical conductivity in carbon blacks. Porosity may exist in the form of relatively mild surface pitting or as an actual hollowing of individual carbon particles. Hollowing greatly lowers the mass of individual particles. Thus, hollow-particle-type carbon blacks have a much larger number of aggregates per unit weight of sample in comparison to normal particles. The surface area also increases significantly, both because of higher surface per particle and the greater total number of particles per unit weight. It is known that carbon blacks with hollow particles are important in maximizing electrical conductivity at reduced loadings.

By employing the right type and loading of conductive filler material it is possible to impart an appropriate level of electrical conductivity to any jacketing material used for electrical cables, such as heating cables for example. The limiting factor is typically the change in mechanical properties (bending and elongation limitations) brought about by incorporation of the conductive filler into the jacketing material.

Volume resistivity ($\rho$), the inverse of conductivity, is defined as the resistance in ohms that a unit volume of a material offers to the flow of electrical current. As used herein resistivity of a conductive polymer sample in ohm-centimeters is equal to the resistance R in ohms multiplied by the cross-sectional area A in square centimeters and the result divided by the sample length l (i.e. the current path length) in centimeters or $\rho = RA/1$. Volume resistivities in a polymeric matrix can range from about $10^{15}$ ohm-cm for pure (i.e. unfilled) polymer down to about 0.1 ohm-cm for carbon black filled composites, or 0.01–0.001 ohm-cm for metal filled composites. The actual volume resistivity will depend upon the percentage by weight and type of the conductive filler and the particular polymer. It is preferred that the volume resistivity, measured at 20° C., for the composition in the ground plane layer be 0.1 to 100 ohm-cm. The loading of particulate conductive filler is preferably 2 to 50%, particularly 5 to 30%, especially 5 to 25%, more especially 5 to 22% by weight of the total composition. Particularly preferred as ground plane compositions are compositions in which the polymeric component is a fluoropolymer, such as EFTE, e.g. Tefzel™ HT2181 made by Du Pont, or ETFE combined with CTFE, e.g. Halar™ 930 made by Ausimont USA, Inc., and the particulate conductive polymer comprises carbon black or a mixture of carbon black and carbon fibers. For such fluoropolymer compositions, the particulate conductive filler is preferably 3 to 30% by weight of the total composition.

The composition used in the jacketing layer 102 may comprise additional components, such as process aids, antioxidants, inert fillers, nonconductive fillers, chemical crosslinking agents, radiation crosslinking agents (often referred to as prorads or crosslinking enhancers), stabilizers, dispersing agents, coupling agents, acid scavengers (e.g. $CaCO_3$), or other components.

The jacketing layer 102 not only provides a braidless ground plane, it is also formulated to provide desired mechanical properties to the heating cable 100 including, for example, impact resistance, flexibility, tear strength, abrasion resistance, cut-through resistance, cold bend resistance and suitable tensile elongation without rupture or failure. The mechanical stiffness of elastomer systems becomes significantly higher with increasing structure. Generally, the mechanical stiffness of the jacketing layer 102 will increase as the percentage by weight of conductive filler material added to the elastomer system increases. However, flexibility of the jacketing layer 102 depends not only on the filler loading level, but also on the type of mixing equipment and product preparation method employed.

In order to improve and promote electrical conductivity, the layer 102, and wire 104, may be simultaneously applied to the heater body 16 and inner jacket 18, most preferably by pressure extrusion to produce a cable construction 100 as shown, for example, in FIG. 4. Alternatively, the wire 104 may be placed directly against the combination of heater body 16 and innerjacket 18, and the layer 102 is then extruded over the ground drain wire 104 and heater body-inner jacket combination. By "pressure extrusion" is meant that the polymer in the plastic state is extruded from a die under sufficient pressure to maintain a specified geometry. Further details relating to pressure extrusion methods can be found in U.S. Pat. No. 5,300,700 referenced and incorporated hereinabove.

Figure 5:
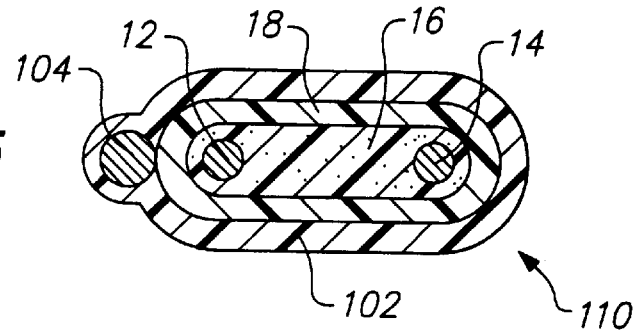
FIG. 5 is an enlarged, diagrammatic cross-sectional view of an alternative heating cable having a drain wire placed adjacent to an inner insulative layer and a conductive polymer formed around the inner insulative layer and the drain wire, in accordance with principles of the present invention.
Figure 6:
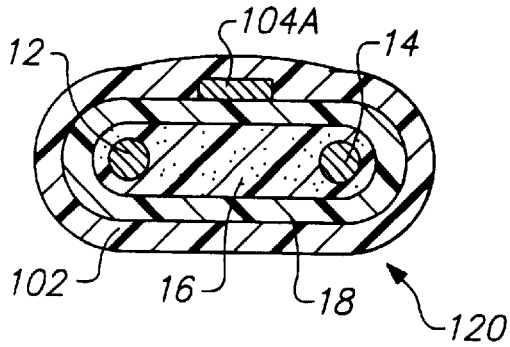
FIG. 6 is an enlarged, diagrammatic cross-sectional view of an alternative heating cable having a generally rectangular metal foil drain electrode placed adjacent to an inner insulative layer and a conductive polymer formed around the inner insulative layer and the metal drain electrode, in accordance with principles of the present invention.

The drain wire 104 is most preferably stranded copper bus wire, such as 19-strand wire, for example, and of sufficiently large gauge to provide a highly conductive path to ground. In order to increase and promote electrical contact with the polymer layer 102, the wire 104 may be coated with a conductive ink and then heated as part of the conductive layer extrusion process, as taught for example in U.S. Pat. No. 4,426,339, referenced and incorporated hereinabove. While stranded copper bus wire is preferred as the drain wire 104, the drain electrode function may be provided by conductors of other geometry. FIG. 6 illustrates a heating cable 120 in which a ground conductor 104A is formed as a metal foil strip having a cross-sectional area equivalent to the stranded wire 104 shown in FIGS. 4 and 5. The strip 104A (or wire 104) may extend lineally along the cable construction, or it may be wrapped in a helix along the cable construction, so long as the conductor 104, 104A is maintained in effective electrical contact with the conductive polymer ground plane layer 102.

Figure 7:
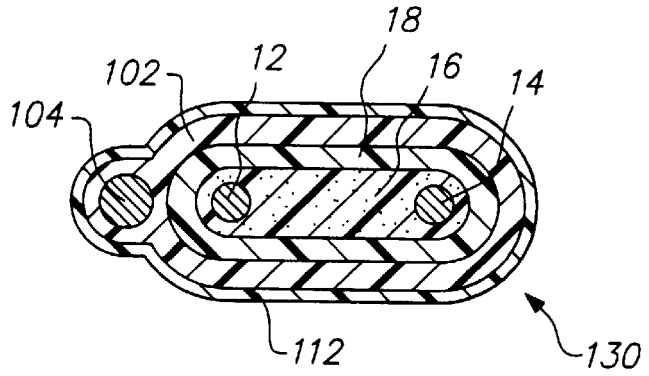
FIG. 7 is an enlarged, diagrammatic cross-sectional view of an alternative heating cable having a construction generally in accordance with the FIG. 4 embodiment and also having an outer nonconductive jacket, in accordance with principles of the present invention.

In some situations a cable, such as a heating cable 130, may be exposed to certain organic solvents, such as toluene or methyl ethyl ketone. Depending upon the degree of crosslinking resulting from irradiation or chemical crosslinking, the solvents may adversely affect the cable. Accordingly, an electrical cable 130 shown in cross-section in FIG. 7 is provided with a thin nonconductive outer jacket 112 surrounding the conductive jacketing layer 102. Preferably, the outer jacket 112 is a fluoropolymer such as ETFE, ETFE-CTFE, FEP or PFA which has a preferred thickness in a range of 0.05 to 0.76 mm (0.002 to 0.030 inch), and particularly in a range of 0.25 to 0.38 mm (0.010 to 0.015 inch) thickness. For heating cables in which the inner jacket is based on a thermoplastic elastomer, it is possible to use polyethylene, e.g. high density polyethylene, as the outer jacket. The thickness is chosen to be as thin as practical in order to provide adequate protection to the cable construction given manufacturing tolerances, while at the same time to minimize materials costs, particularly if fluoropolymer materials which at present tend to be relatively costly, are used.

In some applications it may be desirable or necessary to provide two ground drain wires. An example of a strip heater cable 140 having two drain wires 104 and 106 is shown in cross-section in FIG. 8. The second drain wire 106 is on an opposite side of the generally flat cable 140 and most preferably has the same properties and size as the wire 104. Depending upon the intended use environment, the cable 140 may or may not be provided with the thin outer jacket 112 as described in conjunction with the FIG. 5 embodiment, above. Also, while the drain wires 104 and 106 are shown formed along opposite edges of a generally flat cable construction 140 in order to facilitate bending, other constructions and geometric arrangements of the drain wires may be provided, depending upon factors such as bending and elongation characteristics required of the cable.

Figure 9:
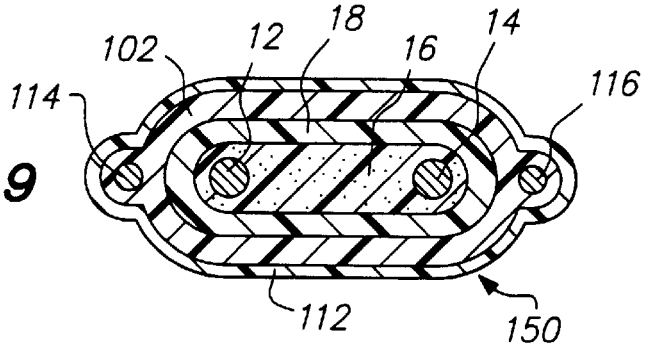
FIG. 9 is an enlarged, diagrammatic cross-sectional view of a heating cable having a ground plane layer including a conductive polymer and two drain wires of reduced gauge (cross-sectional area), in accordance with principles of the present invention.
Figure 10:
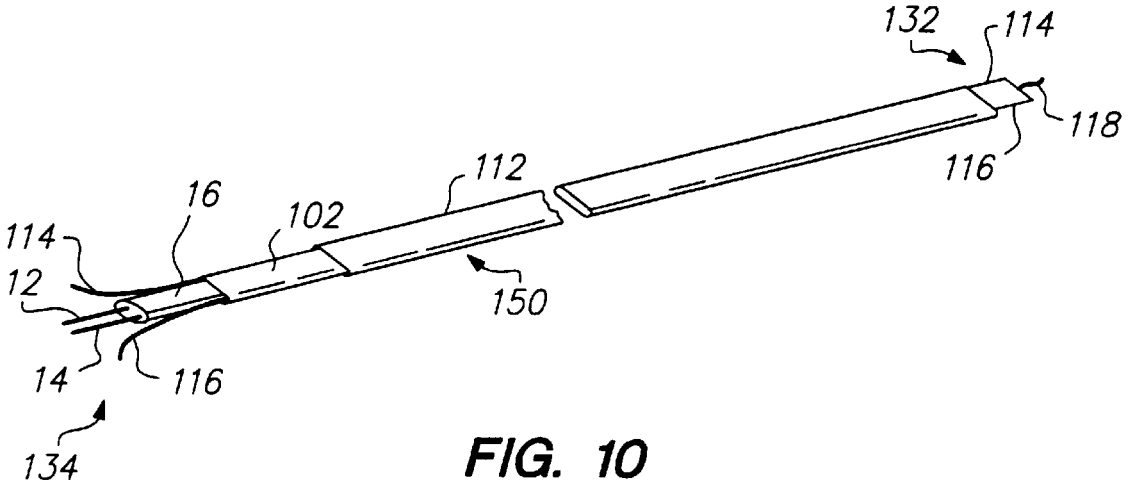
FIG. 10 is a diagrammatic, isometric view of a segment of the FIG. 9 heating cable showing the two reduced-gauge drain wires connected together at a distal end of the cable to provide an equivalent ground fault detection capability to the capability of a full-gauge single drain wire embodiment, in accordance with principles of the present invention.

In some situations it may be useful or desirable to increase the volume resistivity of the ground plane layer 102 and/or reduce the cross-sectional areas of the two drain wires, in order to promote cable flexibility, for example. In such situations, a smaller drain wire will carry less current, and two smaller diameter drain wires can be sized to carry fault currents equivalent to one large diameter drain wire. An example of a heating cable 150 having reduced-diameter drain wires 114 and 116 is shown in FIG. 9. If a short occurs between the phase conductor 12 and one of the drain wires 114, 116 in the middle of a length of heating cable 150, and the two drain wires 114 and 116 are connected in series at a distal end 132 of the cable 130 as shown in the FIG. 10 diagram, then the resistance is less than what it would be if the two drain wires 114, 116 were not connected at the distal end 132; since one current path back to the GFPD is directly via the shorted drain wire, and the other current path is via the shorted drain wire, drain wire interconnect at the distal end, and other drain wire back to the GFPD sensor. FIG. 10 shows a length of the cable 150 having a proximal end region 134 shown stripped of outer jacket 112, conductive polymer ground plane layer 102 and inner heater body 16 to expose conductors 12, 14, 114 and 116 for electrical connections at a breaker panel, and a twist connection 118 of the two ground drain wires 114 and 116 at a distal end 132 of the cable 150.

Since the primary electrical function of the layer 102 is ground fault detection, and since the cable 100 is a strip heater, it will be appreciated by those skilled in the art that the layer 102 most preferably approaches a low or even zero temperature coefficient (ZTC) over an expected thermal operating range of the strip heater. A widely varying temperature coefficient (e.g. PTC or NTC) can be tolerated at temperatures outside of the expected thermal operating range of the strip heater cable 100.

Those skilled in the art will appreciate that for the ground plane layer 102 to function as a ground fault sensor it must manifest a relatively low resistance between, e.g., the phase conductor 12 and the drain wire 104 in order that at least a 30 mA current flow is ensured. This means that if the phase conductor 12 and neutral conductor 14 are carrying a potential difference of at least 100 V root mean square (RMS) alternating current, e.g. about 117V, the resistance at the leakage site 34 must be sufficiently low, on the order of 3900 ohms or less, in order to result in the 30 mA leakage current flow over the drain wire 104 to be sensed by GFPD 32 at the breaker panel 24. It has been surprisingly discovered that current flow through the conductive polymer layer 102 at the leakage site 34 causes a marked drop in measured resistance between the phase conductor 12 and the drain wire 104 at the GFPD.

Figure 11:
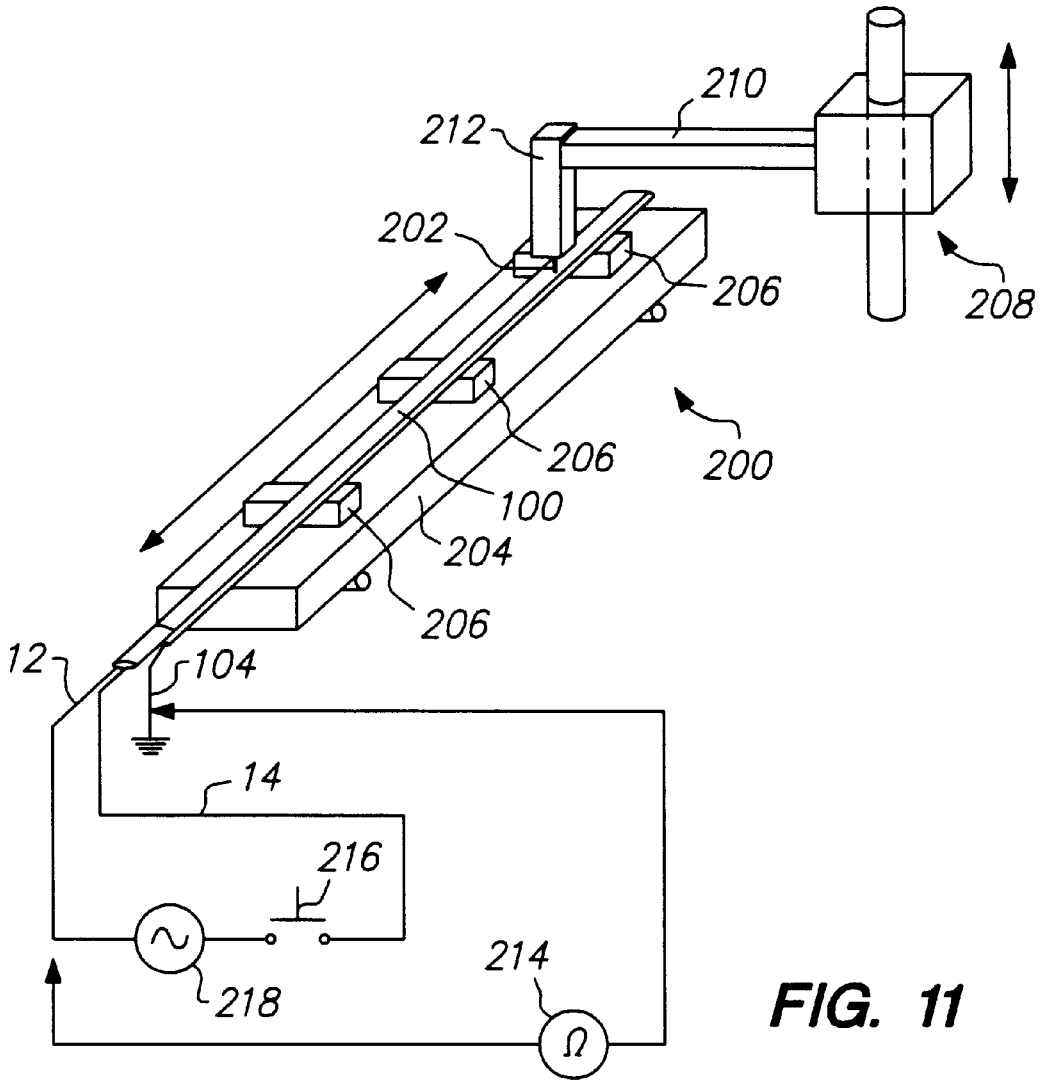
FIG. 11 is a diagrammatic view of a staking and measuring apparatus for driving a metal spike into a segment of the FIG. 4 heating cable, for applying operating power, and for measuring resistance between the phase lead and the ground wire before and after application of operating power, in accordance with principles of the present invention.
Figure 12:
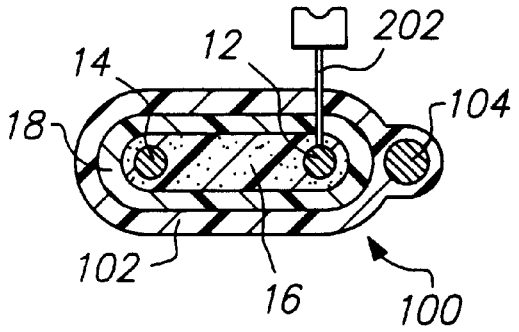
FIG. 12 is an enlarged, diagrammatic cross-sectional view of the FIG. 4 heating cable in which the phase wire has been impaled with the spike of the FIG. 11 apparatus.

As shown in FIG. 11, a spiking or impaling machine 200 is provided. The machine 200 impales e.g. a 1 mm diameter metal spike 202 through a ground plane layer, whether conventional wire braid 20, or the polymeric conductive layer 102, to a depth sufficient to reach the phase conductor 12 in each of the samples, as shown in FIG. 12. The machine 200 includes a table 204 and spacer blocks 206 which support alternately sample lengths (e.g. 12–15 inches in length) of conventional cable 10, and of braidless cable 100. The table 204 may be longitudinally displaced (e.g. by following a lead screw (not shown)), so that the metal spike 202 can be driven into the cable sample undergoing testing at multiple desired locations along the length thereof. An automatic driving mechanism 208 including an arm 210 and a spike chuck 212, applies driving force to the metal spike 202 of sufficient magnitude to drive the spike through the conductive polymer ground plane layer 102, the insulative inner layer 18, and the heater body 16 until the phase conductor 12 is effectively electrically contacted, as shown in FIG. 12.

A first resistance measurement is then taken with an ohmmeter 214 connected between the phase conductor 12 and the ground drain wire 104 before operating power is applied, and the first resistance is recorded. Then, a breaker switch 216 connects a power source 218, such as an alternating current main at a breaker panel (not shown), to the phase and neutral conductor 12 and 14. Power is quickly removed by automatic opening or tripping of the breaker switch 214 (which preferably includes the GFCD function tripping at e.g. 30 mA). The resistance is again read with the ohmmeter 214 connected across the phase conductor 12 and ground drain wire 104 (i.e. the second resistance), and this second resistance is recorded. When the ground fault artificially established by the spike 202 is followed by application of operating power, the fault resistance of the braidless cable sample remains at the lowered, i.e. second, level. The fault resistance may be lowered further by creating a plurality of ground fault sites along the braidless cable sample undergoing testing. It is preferred that the second resistance value is at least less than half of the first resistance value, preferably at least less than one fifth of the first resistance.

The invention is illustrated by the following examples, in which Example 1 is a comparative example.

EXAMPLE 1 (Comparative)

A standard 5BTV™ heating cable, available from Raychem HTS, a Tyco Flow Controls company, was used. The heating cable had a dogbone-shaped core similar to that shown in FIG. 2, with a thickness of about 6.35 mm (0.25 inch) and a width of about 11.7 mm (0.46 inch). The core, comprising a mixture of ethylene/ethyl acrylate copolymer, medium density polyethylene, and carbon black, surrounded two 16AWG stranded nickel-copper electrodes having a center-to-center distance of about 0.5 mm (0.020 inch). The core was surrounded with a modified polyolefin inner jacket having a thickness of about 0.8 mm (0.032 inch), and was then irradiated to about 12 to 14 Mrad. The innerjacket was then surrounded by a 7/34 AWG tin-coated copper braid with 70% minimum coverage. An outer jacket comprising modified polyolefin with a thickness of about 0.8 mm (0.032 inch) was extruded by a tube-down process over the braid. The heating cable had a resistance of about 1100 ohms/foot.

EXAMPLE 2

Using a pressure extrusion technique, the heating cable of Example 1, without the tinned copper braid or the outer jacket, was covered with a 0.75 mm (0.03 inch) thick layer of a conductive ground plane layer comprising 78% by weight of a modified polyolefin (i.e. flame-retarded TPE sold under the tradename GTPO 8102R, available from Gitto/Global Co.) and 22% by weight carbon black (Vulcan™ XC-72, available from Cabot Corporation). The ground plane composition had a resistivity (when measured in the form of an extruded sample with dimensions of about 6.4×99×1.1 mm (0.25×3.9×0.045 inch)) at 20° C. of about 22 ohm when measured in the machine direction and about 44 ohm-cm when measured in the transverse direction. Simultaneously with the extrusion of the ground plane layer, a 16 AWG stranded nickel-coated copper drain wire coated with an aqueous graphite-filled conductive ink (Aquadag™ E, available from Achesion Colloids) which was dried before extrusion was embedded in the ground plane layer, as shown in FIG. 7. A test of the resistance of the ground plane composition as a function of temperature showed that the resistance of the composition was relatively stable over the operating range of the heating cable, i.e. 20 to 100° C., increasing about 2×.

EXAMPLE 3

Figure 8:
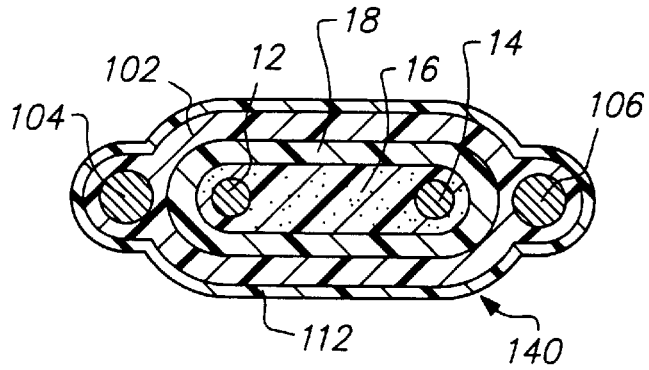
FIG. 8 is an enlarged, diagrammatic cross-sectional view of an alternative heating cable having a ground plane layer including a conductive polymer and two ground drain wires, in accordance with principles of the present invention.

Following the procedure of Example 2, the heating cable of Example 1, without the tinned copper braid or the outerjacket, was covered with a 0.75 mm (0.03 inch) thick layer of a conductive ground plane layer. The composition of the ground plane layer comprised 38.50% ETFE (Tefzel™ 2129, available from DuPont), 31.45% of a terpolymer of tetrafluoroethylene (TFE), hexachloropropylene (HCP) and vinylidene fluoride (VDF) (THV™ 200, available from 3M), 8.50% of a triblock copolymer containing ETFE and an elastomeric segment of TFE, HCP, and VDF (Dai-el™ T530, available from Daikin), 7.5% carbon black (Ketjenblack™ EC300J, available from Noury Chemical Corporation), 7.5% carbon fibers (AbCarb™ 99 type 401 PAN-based high purity carbon milled carbon fibers, available from Textron Systems Corporation), and 3.7% of an antioxidant/additive package, all percentages by weight of the total composition. The ground plane composition had a resistivity, when measured as described in Example 2, of about 0.5 ohm-cm when measured in the machine direction. Simultaneously with the extrusion of the ground plane layer, two 16 AWG stranded nickel-coated copper drain wires, coated with Aquadag™ E and dried before extrusion, were embedded in the ground plane layer, as shown in FIG. 8.

Ten samples of each of Examples 1 to 3 were cut, each sample having a length of 0.305 m (12 inch). Each sample was tested using the spiking or impaling machine 200 shown in FIGS. 11 and 12. The following Table I comprises a tabulation of measured resistance following driving of the spike into each braidless cable sample before application of primary power, and after application of primary power, to the braidless cable sample. In every case once power was applied the GFPD 32 tripped. On standard braid samples 3, 4, 6 to 8 and 10 of Comparative Example 1 the 20 A main breaker also tripped following application of power. The 20 A main breaker was not tripped by the faults in the heating cable samples employing polymeric ground plane layers. The data of Table I demonstrates an unexpected reduction in resistance following application of power in each of the samples having polymeric ground plane layers 102.

TABLE I

| | Example 1 (Comparative) | | Example 2 | | Example 3 | |
|---|---|---|---|---|---|---|
| Sample | R (ohms) before power | R (ohms) after power | R (kohms) before power | R (ohms) after power | R (kohms) before power | R (ohms) after power |
| 1 | <0.2 | <0.2 | 4.9 | 182 | 2.9 | 103 |
| 2 | <0.2 | <0.2 | 4.6 | 152 | 1.3 | 47 |
| 3 | <0.2 | <0.2 | 5.1 | 269 | 0.292 | 36 |
| 4 | <0.2 | <0.2 | 3.6 | 234 | 1.2 | 64 |
| 5 | <0.2 | <0.2 | 6.7 | 166 | 0.52 | 36 |
| 6 | <0.2 | <0.2 | 2.6 | 227 | 0.162 | 94 |
| 7 | <0.2 | <0.2 | 5.6 | 205 | 0.087 | 200 |
| 8 | <0.2 | <0.2 | 7.5 | 840 | 0.219 | 90 |
| 9 | <0.2 | <0.2 | 2.2 | 171 | 0.387 | 48 |
| 10 | <0.2 | <0.2 | 3.1 | 176 | 0.46 | 61 |

Those skilled in the art will appreciate that many changes and modifications will become readily apparent from consideration of the foregoing descriptions of preferred embodiments without departure from the spirit of the present invention, the scope thereof being more particularly pointed out by the following claims. For example, while the cable 100 has been described as a heating cable having two conductors embedded within a conductive polymer core, the jacketing layer can effectively be provided for a wide variety of electrical cables and other forms of zone heaters, such as strip heaters having nichrome heater wire spiral-wrapped around an insulative polymer core embedding two parallel conductors, wherein the nichrome heater wires are connected to the conductors at spaced-apart locations along the heater strip; or strip heaters having conductive fibers spiral-wrapped around an insulative polymer core and connected to two elongated conductors held apart by the core. Also, the conductive polymer layer 102 need not be continuous, but could be provided as a longitudinal segment, or a series of spaced-apart transverse segments, in connection with the drain wire 104, depending upon the particular application or requirement. Other electrical strip heater arrangements providing $I^2R$ heating would also benefit from inclusion of a jacketing layer in accordance with principles of the present invention. The descriptions herein and the disclosures hereof are by way of illustration only and should not be construed as limiting the scope of the present invention.

What is claimed is:

1. An electrical device comprising:

(1) a heater element including first and second elongate wire electrodes which are in direct electrical contact with a continuous strip of electrically conductive material;

(2) an inner electrically insulating jacket layer surrounding the heater element; and (3) a braidless ground plane layer covering the inner electrically insulating jacket layer and comprising a layer of electrically conductive polymer formed to be in electrical contact with at least one drain wire electrode.

2. The electrical device set forth in claim 1 wherein the at least one drain wire electrode is embedded within the layer of electrically conductive polymer.

3. The electrical device set forth in claim 2 wherein the at least one drain wire electrode is embedded within the layer of electrically conductive polymer by pressure extrusion.

4. The electrical device set forth in claim 1 wherein the at least one drain wire electrode is positioned outwardly adjacent the inner electrically insulating jacket layer and the layer of electrically conductive polymer is formed over a combination comprising (i) the at least one drain wire electrode, and (ii) the inner electrically insulating jacket layer and heater element.

5. The electrical device set forth in claim 1 wherein the heater element comprises an electrically conductive polymer.

6. The electrical device set forth in claim 1 wherein the heater element comprises an electrically insulative polymer spacer for spacing apart the first and second elongate wire electrodes, and wherein the continuous strip of conductive material comprises at least one heater filament wrapped around and connected to the first and second elongate wire electrodes.

7. The electrical device set forth in claim 6 wherein the at least one heater filament comprises an electrically conductive polymer.

8. The electrical device set forth in claim 6 wherein the at least one heater filament comprises metallic wire.

9. The electrical device set forth in claim 1 wherein the electrically conductive polymer of the braidless ground plane layer comprises a polymeric component having dispersed therein a particulate conductive filler.

10. The electrical device set forth in claim 9 wherein the particulate conductive filler comprises at least one of carbon black, carbon fibers, metal particles, graphite and metal fibers, and metal-coated graphite fibers.

11. The electrical device set forth in claim 10 wherein the percentage by weight of the particulate conductive filler to total composition lies in a range of 2 percent to 50 percent.

12. The electrical device set forth in claim 10 wherein the percentage by weight of the particulate conductive filler to total composition lies in a range of 5 percent to 30 percent.

13. The electrical device set forth in claim 10 wherein the particulate conductive filler comprises a mixture of carbon black and carbon fibers.

14. The electrical device set forth in claim 13 wherein the electrically conductive polymer comprises a fluoropolymer matrix having a particulate conductive filler comprising a mixture of carbon black and carbon fibers in a range of 3 to 30 percent by weight of the total composition.

15. The electrical device set forth in claim 1 wherein the braidless ground plane layer comprises a plurality of drain wire electrodes which are in electrical contact with the layer of electrically conductive polymer.

16. The electrical device set forth in claim 1 further comprising a non-electrically-conductive outer jacket surrounding the braidless ground plane layer.

17. The electrical device set forth in claim 16 wherein the non-electrically-conductive outer jacket comprises a fluoropolymer having a layer thickness of 0.05 to 0.76 mm.

18. The electrical device set forth in claim 17 wherein the layer thickness of the non-electrically-conductive outer jacket lies in a range of 0.25 to 0.38 mm.

19. The electrical device set forth in claim 1 wherein the electrically conductive polymer of the ground plane layer comprises (i) a thermoplastic elastomer matrix, and (ii) dispersed in the matrix, 5 to 30 percent by weight of total composition carbon black.

20. The electrical device set forth in claim 1 wherein the electrically conductive polymer of the braidless ground plane layer comprises (i) a fluoropolymer matrix, and (ii) dispersed in the matrix 5 to 30 percent by weight of the total composition a particulate conductive filler.

21. The electrical device set forth in claim 2 wherein the electrically conductive polymer is applied to the at least one drain wire electrode and the inner insulating jacket by pressure extrusion.

22. The electrical device set forth in claim 16 wherein the at least one drain wire electrode comprises a plurality of drain wires in electrical contact with the electrically conductive polymer.

23. The electrical device set forth in claim 1 comprising a cable and wherein the electrically conductive polymer of the braidless ground plane layer has a volume resistivity characteristic such that an electrical resistance measured at a terminal end of one of the first and second elongate wire electrodes when a shorting means connects the braidless ground plane layer to said one of the electrodes at a location along a length of the cable has a first resistance value before an operating electrical potential difference is applied between the said one of the electrodes and the at least one drain wire electrode, and has a second resistance value at least less than half of the first resistance value following application of the operating electrical potential difference between the said one of the electrodes and the at least one drain wire electrode.

24. The electrical device set forth in claim 23 wherein the volume resistivity characteristic of the conductive polymer matrix is such that the second resistance value is approximately one fifth less than the first resistance value after the operating electrical potential difference is applied between the said one of the electrodes and the at least one drain wire electrode.

25. The electrical device set forth in claim 23 wherein the operating electrical potential difference is at least 100 volts root-mean-square alternating current.

26. An electrical cable comprising:

(1) a heater element including first and second elongate wire electrodes which are in direct electrical contact with a continuous strip of electrically conductive material;

(2) an inner electrically insulating jacket layer surrounding the heater element; and (3) a braidless ground plane layer covering the inner electrically insulating jacket layer and comprising a layer of electrically conductive polymer formed to be in electrical contact with at least one drain wire electrode, the electrically conductive polymer comprising a polymeric component having dispersed therein a particulate conductive filler material of at least one of carbon black, carbon fibers, metal particles, graphite and metal fibers, and metal-coated graphite fibers wherein a percentage by weight of the particulate conductive filler to total composition of the electrically conductive polymer lies in a range of 2 percent to 50 percent.

27. The electrical cable set forth in claim 26 wherein the electrically conductive polymer of the braidless ground plane layer has a volume resistivity characteristic such that an electrical resistance measured at a terminal end of one of the first and second elongate wire electrodes when a shorting means connects the braidless ground plane layer to said one of the electrodes at a location along a length of the cable has a first resistance value before an operating electrical potential difference is applied between the said one of the electrodes and the at least one drain wire electrode, and has a second resistance value at least less than half of the first resistance value following application of the operating electrical potential difference between the said one of the electrodes and the at least one drain wire electrode.

28. An electrical device comprising:

(1) a heater element including first and second elongate wire electrodes which are in direct electrical contact with a continuous strip of electrically conductive material;

(2) an inner electrically insulating jacket layer surrounding the heater element;

(3) a ground plane layer covering the inner electrically insulating jacket layer and comprising a layer of electrically conductive polymer formed to be in electrical contact with at least one drain wire electrode; and (4) a non-electrically-conductive outer jacket surrounding the ground plane layer and comprising a fluoropolymer having a layer thickness of 0.05 to 0.76 mm.

29. The electrical device set forth in claim 28 wherein the layer thickness of the non-electrically-conductive outer jacket lies in a range of 0.25 to 0.38 mm.

* * * * *